US008177105B2

(12) United States Patent
Shah

(10) Patent No.: US 8,177,105 B2
(45) Date of Patent: May 15, 2012

(54) PORTABLE HAND-HELD PLEATING APPARATUS FOR CREATING PLEATS IN ANY FABRIC MATERIAL

(75) Inventor: Ami Lakdawala Shah, King of Prussia, PA (US)

(73) Assignee: Ami Lakdawala Shah, King of Prussia, PA (US)

( * ) Notice: Subject to any disclaimer, the term of this patent is extended or adjusted under 35 U.S.C. 154(b) by 349 days.

(21) Appl. No.: 12/584,044

(22) Filed: Aug. 28, 2009

(65) Prior Publication Data

US 2011/0049199 A1 Mar. 3, 2011

(51) Int. Cl.
*D05B 35/08* (2006.01)
*D06J 1/00* (2006.01)

(52) U.S. Cl. ..... 223/35

(58) Field of Classification Search ..... 223/28–38
See application file for complete search history.

(56) References Cited

U.S. PATENT DOCUMENTS 628,580 A * 7/1899 Gray ..... 132/225
2,906,441 A 9/1959 Liebeskind
3,191,665 A 6/1965 Rosenbaum
3,613,967 A * 10/1971 Clement ..... 223/32
3,667,677 A * 6/1972 Sprong ..... 223/34
3,695,489 A * 10/1972 Kirche ..... 223/34
3,724,729 A * 4/1973 Sitts ..... 223/35
3,726,449 A * 4/1973 Kern ..... 223/35
3,824,964 A 7/1974 Ryan
3,984,048 A * 10/1976 Rethemeyer et al. ..... 223/35
4,042,155 A 8/1977 Sprong
4,157,775 A 6/1979 Soto
4,170,053 A 10/1979 Rosenzweig
4,266,699 A * 5/1981 Ladd ..... 223/34
4,917,277 A 4/1990 Hibbard
5,114,056 A 5/1992 Frye
6,041,481 A 3/2000 Martin
6,231,493 B1 5/2001 Kato
7,465,267 B2 12/2008 Goodrich
8,002,156 B2 * 8/2011 Ota ..... 223/35

* cited by examiner

*Primary Examiner* — Ismael Izaguirre

(57) ABSTRACT

A portable hand-held pleating apparatus for fabric material consisting of two halves containing a total of ten to twenty fingers adapted to allow fabric material to be pleated into numerous uniform pleats, specifically accordion pleats. The pleating apparatus can hold fabric material to allow for pleating by any user weaving said material through said fingers and then being removed by a simple upward motion. The pleating apparatus can be adjusted to enable variable pleat widths in a facile way.

9 Claims, 9 Drawing Sheets

PORTABLE HAND-HELD PLEATING APPARATUS FOR CREATING PLEATS IN ANY FABRIC MATERIAL

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to a portable hand-held pleating apparatus of the type adapted to create pleats within any fabric material.

2. Prior Art

Inventors have discovered several industrial methods to create pleats within (1) draperies, such as U.S. Pat. No. 3,824,964 to Ryan (1974), U.S. Pat No. 4,042,155 to Sprong (1977), and U.S. Pat. No. 4,157,775 to Soto (1979); (2) fabric materials, such as U.S. Pat. No. 2,906,441 to Liebeskind (1959), U.S. Pat. No. 4,917,277 to Hibbard (1990), and U.S. Pat. No. 5,114,056 to Frye (1992); (3) paper, such as U.S. Pat. No. 7,465,267 to Goodrich (2008); and (4) sheet-like material, such as U.S. Pat. No. 6,231,493 to Kato (2001). All of these inventions are large, bulky and meant mainly for industrial use. All of these differ greatly from the hand-held pleating apparatus described herein where the objective is a compact light-weight pleating apparatus for use by any individual anywhere.

Additionally, inventors have established methods for creating the appearance of pleats within draperies such as U.S. Pat. Nos. 3,191,665 to Rosenbaum (1965), U.S. Pat. No 4,170,053 to Rosenzweig (1979), and U.S. Pat. No. 6,041,481 to Martin (2000). These inventions only create an illusion of pleated fabric material and do not provide a method for actually generating uniform pleats within any fabric.

No compact portable apparatuses are known for creating uniform pleats within fabric material. Additionally, there is no known mechanism to aid in the proper wearing of a traditional sari, dhoti, or long scarf where many meters of fabric must be pleated for the garment to be worn.

OBJECTS AND ADVANTAGES

The primary object of this invention is to provide a hand-held pleating apparatus that overcomes the above-mentioned problem associated with no known portable hand-held tool for creating pleats and which, nevertheless, provides a straightforward mechanism of creating uniform pleats of varying widths within any fabric material in a facile way. One form of fabric material is a sari, dhoti, sarong or long scarf where many meters of fabric material are required to be pleated to be worn.

Currently a sari, usually between 5.5 to 8 meters long, is worn with multiple uniform pleats being created manually and many times with aid from an additional person. Wearing a sari requires frequent practice and dexterity and there is no tool to assist this process. With this invention, fabric material such as a sari is manually tucked around the body whereby the hand-held pleating apparatus is then used to create uniform pleats of all required material, is removed from the fabric material, and the resulting pleats are then tucked and secured with aid from a safety pin or broach resulting in proper wearing of the garment.

More specifically, it is an object of this invention to provide a pleating apparatus construction, which includes a pleat creating attachment in the form of fingers adapted to facilitate insertion of fabric material of varying thickness to be woven through the pleating apparatus by the user. The two rigid support arms are designed such that the narrower arm can slide within the wider arm and lock at varying widths with the narrowest resulting pleat width exceeding the width of a single arm. Each arm of the pleating apparatus contains five to ten laterally spaced fingers that allow for insertion of any fabric material to be woven alternatively through opposing and adjacent fingers to form multiple uniform pleats. The pleating apparatus is portable, compact, and can be carried in a pocket or handbag. Embodiments of the pleating apparatus could exist as two sliding arms with fingers that fold for compact handling, pull apart through pressure fits and separate into three or four segments, or exist as a single solid unit in multiple increasing sizes.

SUMMARY

In accordance with the present invention a portable hand-held pleating apparatus comprises a central rigid body and two sets of opposing multiple finger elements adapted for weaving a selected section of any fabric material alternatively between and around adjacent and opposing fingers to create pleats within said fabric.

DRAWINGS

Figures

Other objects, features, and advantages of the present invention will become apparent from the following description and accompanying drawings, in which.

Figure 13:
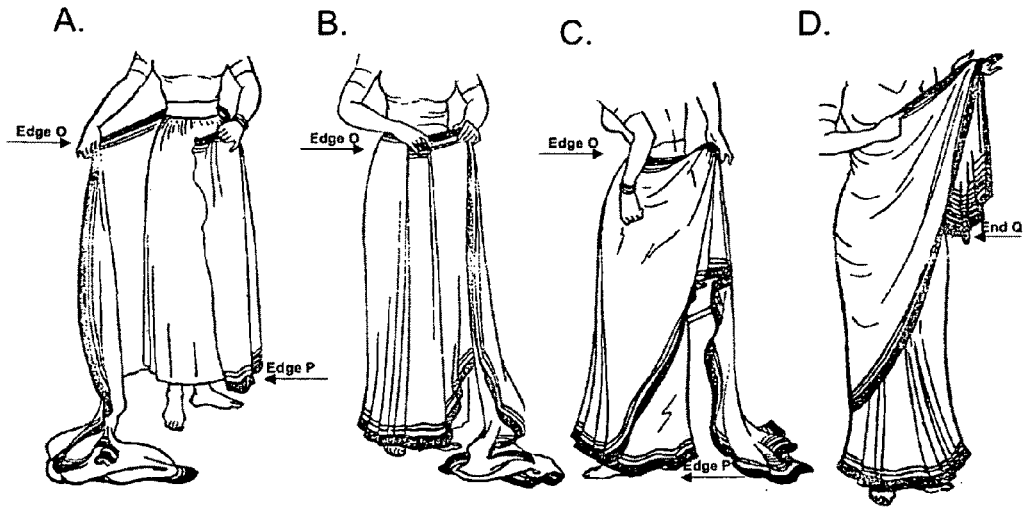

FIG. 13 A-D is an illustrative diagram on wearing a sari (saree).

Figure 14:
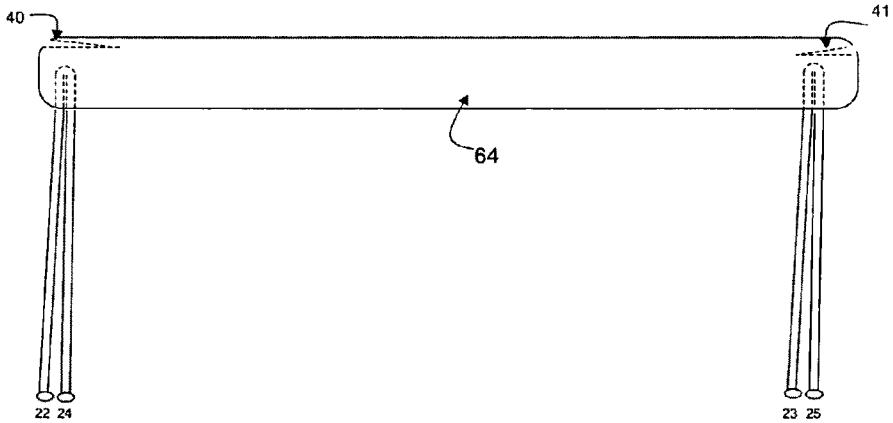

FIG. 14 is a side elevational view of an alternate embodiment of the pleating apparatus.

Figure 15:
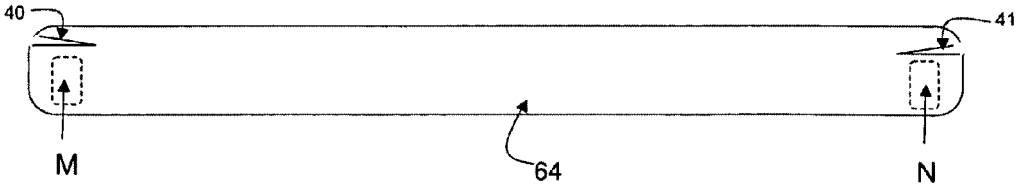

FIG. 15 is a top plan view of an alternate embodiment of the pleating apparatus.

DETAILED DESCRIPTION

Preferred Embodiment

Figure 5:
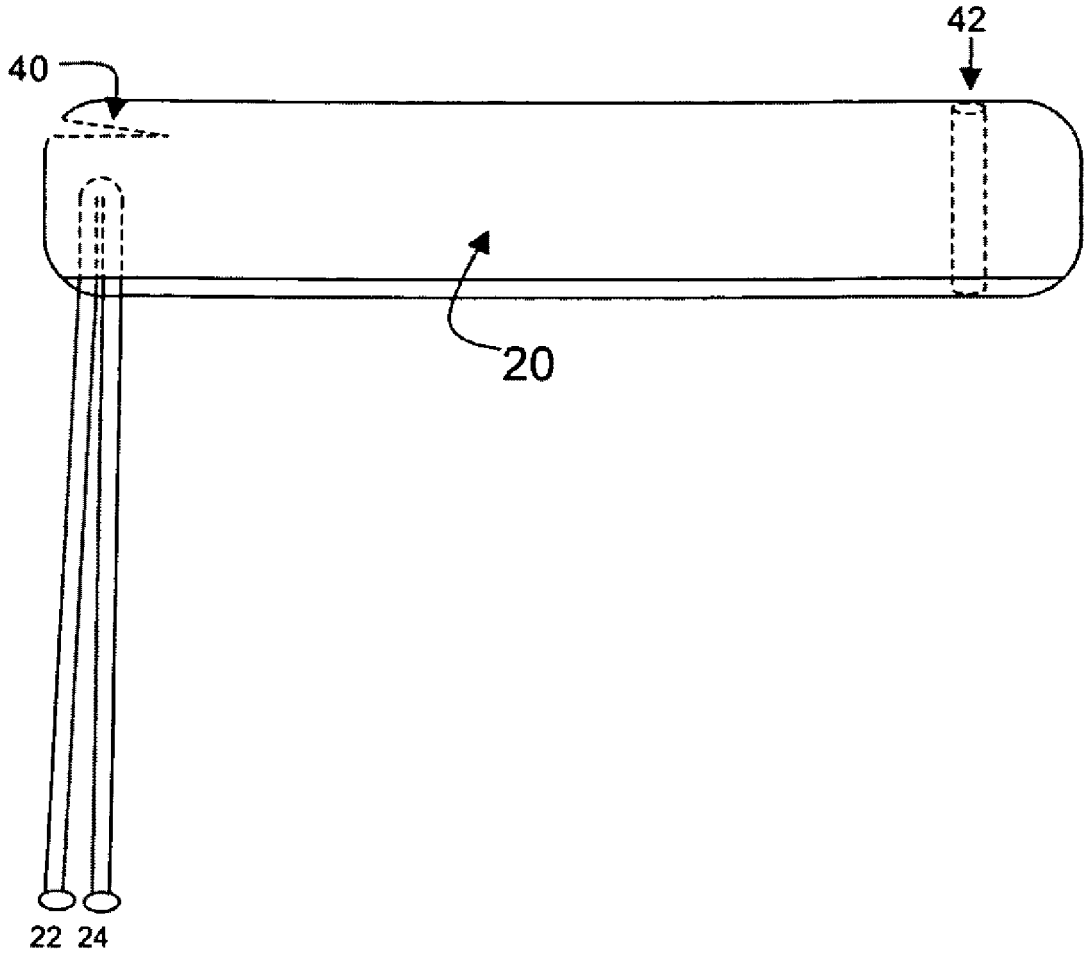
FIG. 5 is a side elevational view of the wider arm of the pleating apparatus.
Figure 6:
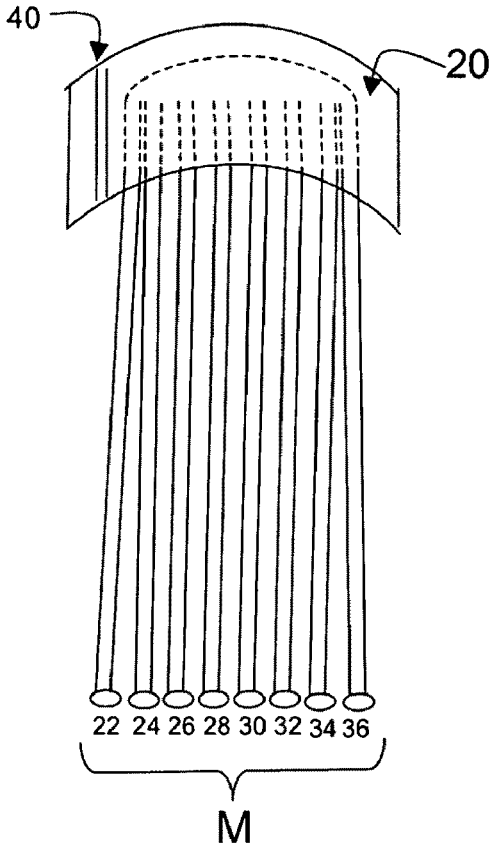
FIG. 6 is a front elevational view of the wider arm of the pleating apparatus.
Figure 7:
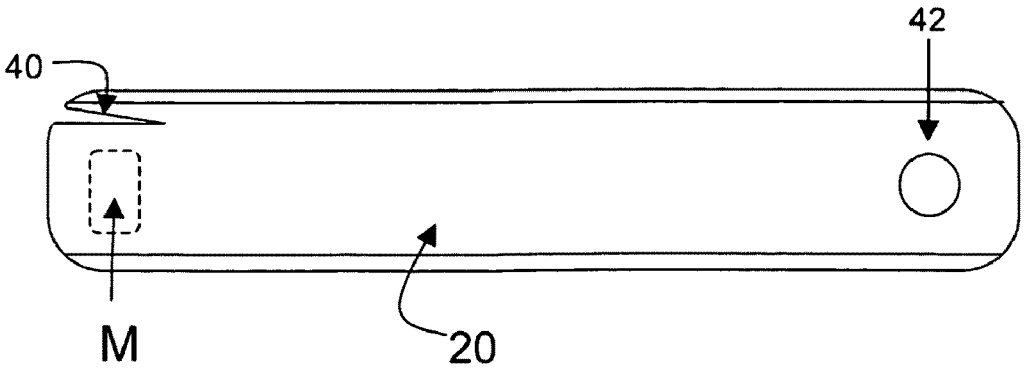
FIG. 7 is a top plan view of the wider arm of the pleating apparatus.

Referring first to FIGS. 5 through 7, the hand-held pleating apparatus of the present invention is preferably formed by a first of two rigid support arms, designated 20, and includes five to ten fingers coated with an agglutinative substance taken from a group consisting essentially of but not limited to plastic, rubberized, and flocking, illustrated as eight fingers designated M (22, 24, 26, 28, 30, 32, 34, 36). All fingers are arranged laterally and imbedded into arm 20 at a preferred 90 degree right angle. As shown in FIG. 6, fingers M flare slightly outwardly in an upward direction. Likewise, as shown in FIG. 5 in one embodiment the outer fingers 22 and 36 can slope slightly rearwardly relative to the plane of the inner fingers 24, 26, 28, 30, 32, 34 in an upward direction.

Figure 8:
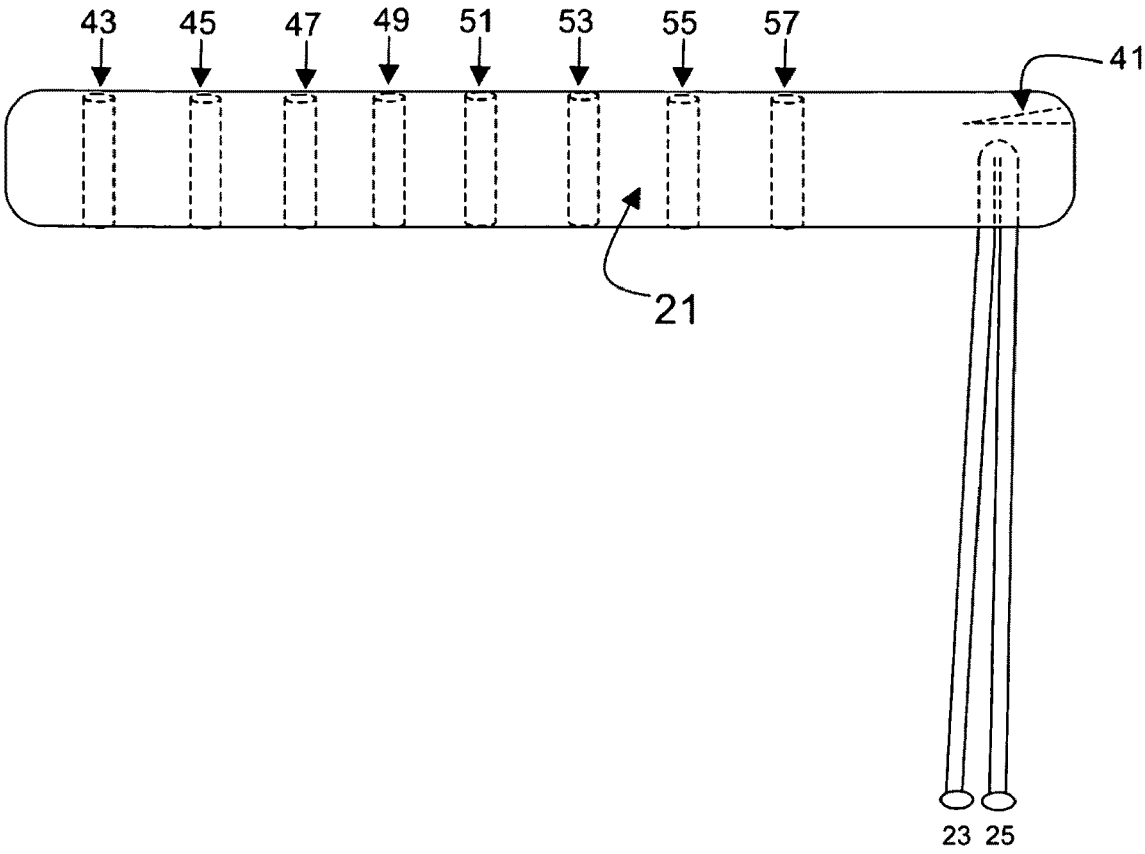
FIG. 8 is a side elevational view of the narrower arm of the pleating apparatus.
Figure 11:
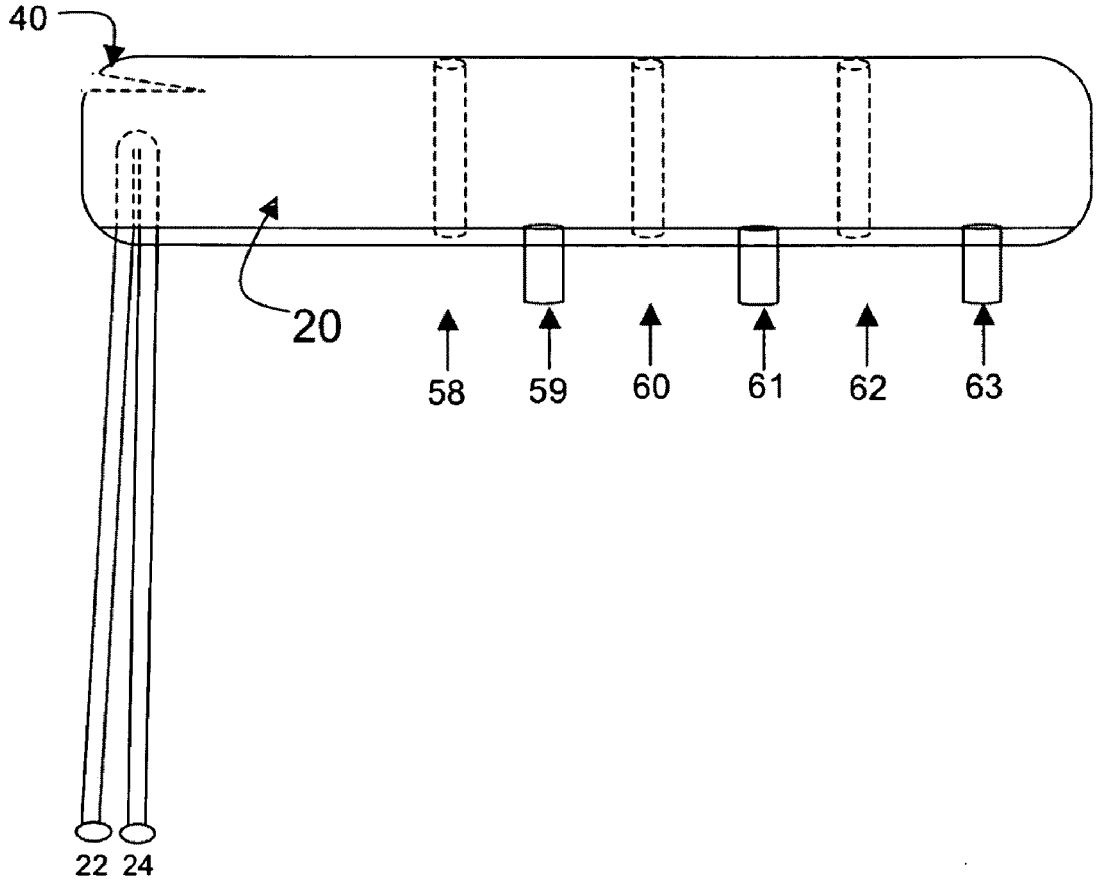
FIG. 11 is a side elevational view of an alternate embodiment of the pleating apparatus.

FIG. 6 illustrates how arm 20 is wider and curves up and over the said second arm, designated 21, in FIG. 8. This feature prevents the pleating apparatus from twisting resulting in asymmetrical pleats. Additionally, one preferred embodiment shown in FIGS. 5 to 7, the arm has a slit or small clip, designated 40, which can grip a corner of the fabric material to be pleated. FIGS. 5 and 7 also illustrate one preferred embodiment having an aperture within arm 20 applied to adjust the width of the pleating apparatus and thusly affecting the width of the resulting pleats. An alternative embodiment is illustrated in FIG. 11 where arm 20 is modified to having alternating a plurality of protrusions and aperatures designated 58, 59, 60, 61, 62, 63.

Figure 9:
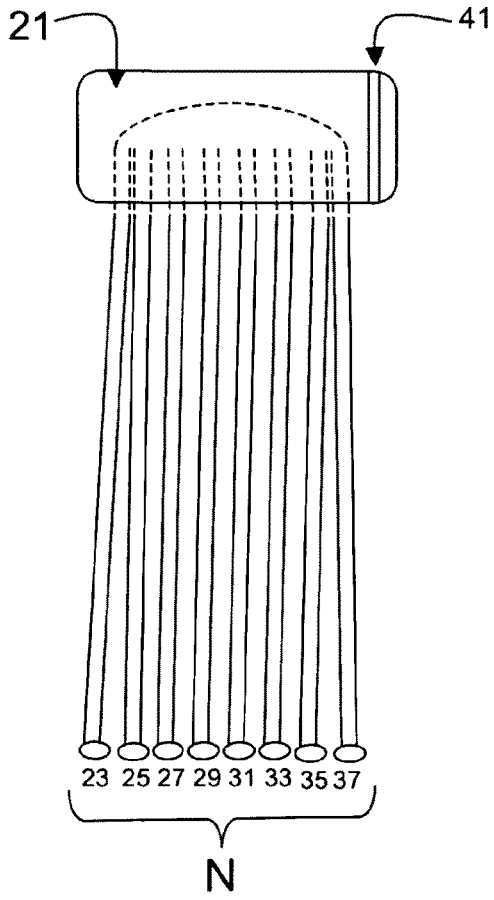
FIG. 9 is a front elevational view of the narrower arm of the pleating apparatus.
Figure 10:
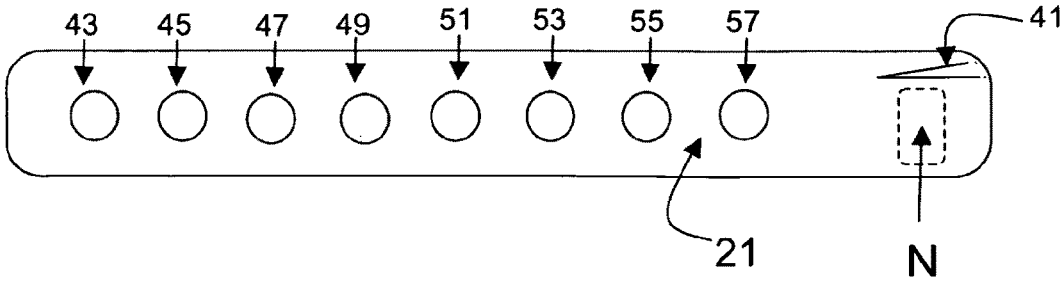
FIG. 10 is a top plan view of the narrower arm of the pleating apparatus.

Referring to FIGS. 8 through 10, the hand-held pleating apparatus of the present invention is preferably formed by a second rigid support arm, designated 21, and includes five to ten fingers coated with a substance to increase tackiness taken from a group consisting essentially of but not limited to plastic, rubberize and flock, illustrated as eight fingers designated N (23, 25, 27, 29, 31, 33, 35, 37). All fingers are arranged laterally and imbedded into arm 21 at a preferred 90 degree right angle. As shown in FIG. 9, fingers N flare slightly outwardly in an upward direction. Likewise, as shown in FIG. 8 in one embodiment the outer fingers 23 and 37 can slope slightly rearwardly relative to the plane of the inner fingers 25, 27, 29, 31, 33, 35 in an upward direction.

FIG. 9 illustrates how this arm, designated 21, is slightly narrower than the first arm of the pleating apparatus and can fit within the curve of the wider arm 20. This feature prevents the pleating apparatus from twisting resulting in asymmetrical pleats. Additionally, one preferred embodiment shown in FIGS. 8 to 10, the arm has a slit or small clip designated 41 that can grip a corner of the fabric material to be pleated. FIGS. 8 and 10 also illustrate one preferred embodiment having a plurality of apertures parallel to the lateral edge of the arm designated 43, 45, 47, 49, 51, 53, 55, 57 are applied to adjust the width of the pleating apparatus and thusly affecting the width of the resulting pleats. Additional embodiments may allow for rigid support arm 21 to slide within arm 20 and lock into place at varying widths.

Referring to FIGS. 6 and 9, the cross-section width of a single finger M and N is not critical but a preferred embodiment is to be thin and any shape circular, square, and hexagonal. The nubbin at the end of each finger is optional and is applied to prevent snagging of fabric. The length of each finger is optional and all fingers M and N are preferred to be uniform in dimension. The resultant pleat penetrates into a certain length of fabric and is dependent upon the length of fingers M and N. The lateral spacing between fingers must be slightly larger than at least two times the thickness of the fabric to be pleated to provide for ease of insertion and weaving. In alternate embodiments the fingers M and N can fold, pull or separate making the apparatus conveniently portable.

Figure 3:
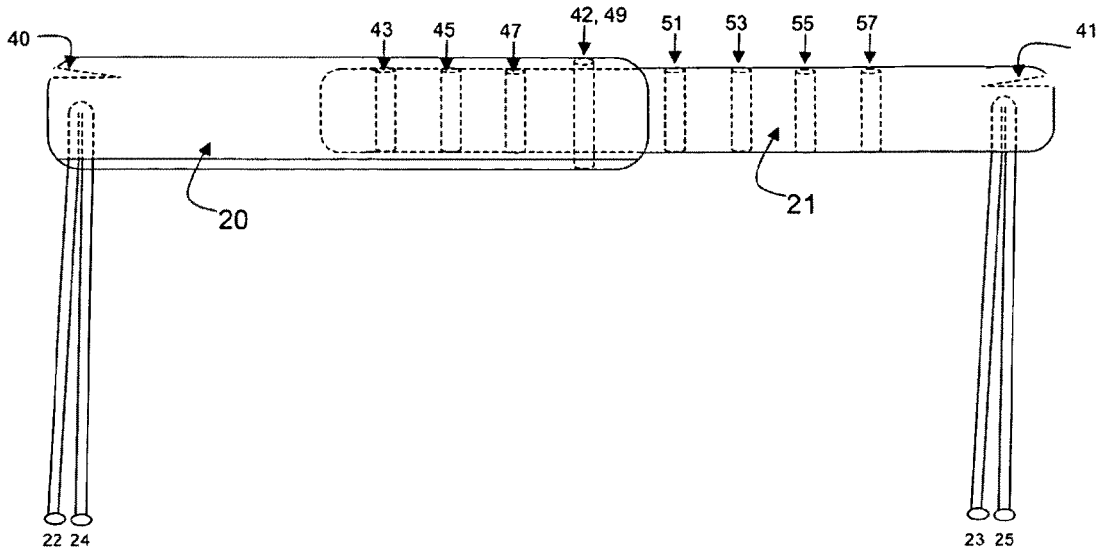
FIG. 3 is a side elevational view of pleating apparatus with rigid member attachment mounted thereon and one embodiment of the locking mechanism demonstrated.
Figure 4:
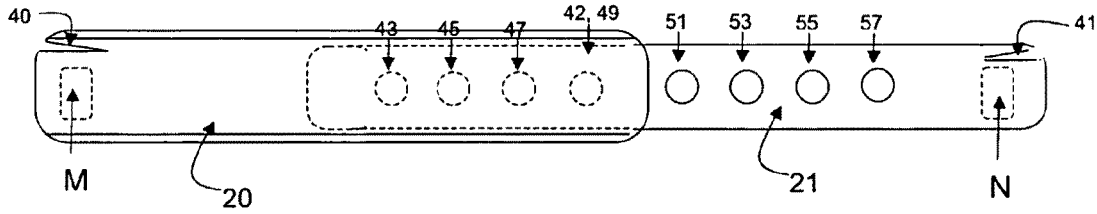
FIG. 4 is a top plan view of the pleating apparatus.

FIGS. 3 and 4 show the assembled hand-held pleating apparatus where the narrower arm 21 is inserted within the wider arm 20. Aligning apertures and inserting a releasable locking mechanism not limited to a screw with washer/nut, locking ring, velcro, and having protrusions with corresponding apertures adjust the width of the ensemble. Illustrated in FIGS. 3 and 4 is alignment of aperture 42 with 49. Fabric material is woven alternately through opposing and adjacent fingers contained within rigid arms 20 and 21.

The invention includes various alternative embodiments that may be constructed of a variety of the same or different materials. In one embodiment the hand-held pleating apparatus consists of a single molded plastic device in which the finger elements are integral with the central gripping section as illustrated in FIGS. 14 and 15. In another embodiment the apparatus may consist of metal prongs embedded in a penetrable material such as a wood block or drilled material for pressure fitting the prongs. Still other embodiments may be constructed of multiple components with the finger elements releasably attached to the central gripping member. Alternatively, the finger elements may be attached by hinged devices to provide a foldable apparatus. In one-piece devices such as the single molded plastic, illustrated in FIGS. 14 and 15, the pleating width is predetermined by the distance chosen for the center gripping section between the opposing finger-like elements. Any suitable distance may be chosen though generally for a sari the distance will be between about three to eight inches. In still other embodiments with multiple components, the distance between the opposing finger elements may be adjustable to allow for producing pleated fabric of different pleat widths depending on the setting of the adjustable center section. Additionally, other means for varying the distance between the respective finger elements may be employed as are readily available to those skilled in the art.

Obviously the apparatus of the invention may be fitted with or constructed from decorative elements and may be combined with other functional elements such as a lint brush or other surface attached to the central gripping portion. All of such optional devices are intended to be included within the scope of the invention.

Figure 1:
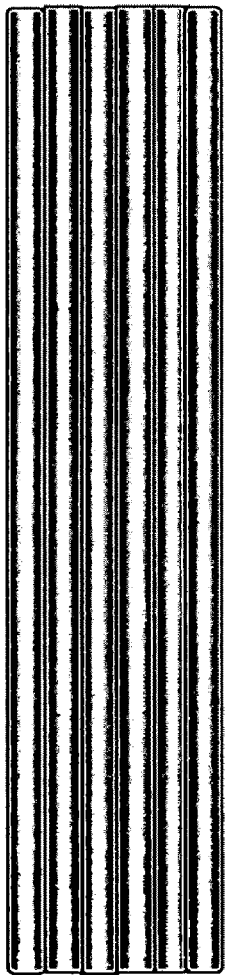
FIG. 1 is a fragmentary front elevational view of a fabric material having pleats formed therein by means of the hand-held pleating apparatus of the present invention.
Figure 2:
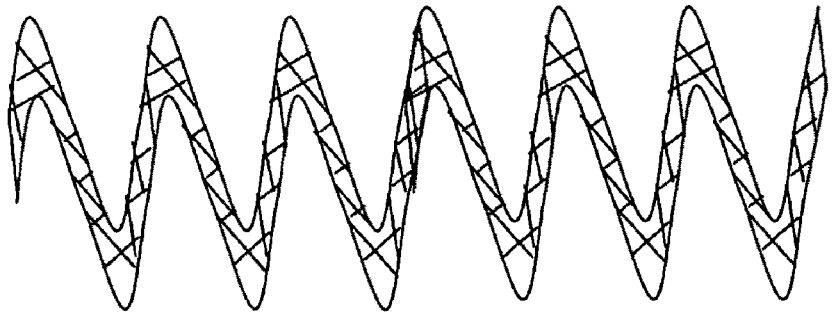
FIG. 2 is a top plan view of the pleated fabric material shown in FIG. 1.
Figure 12:
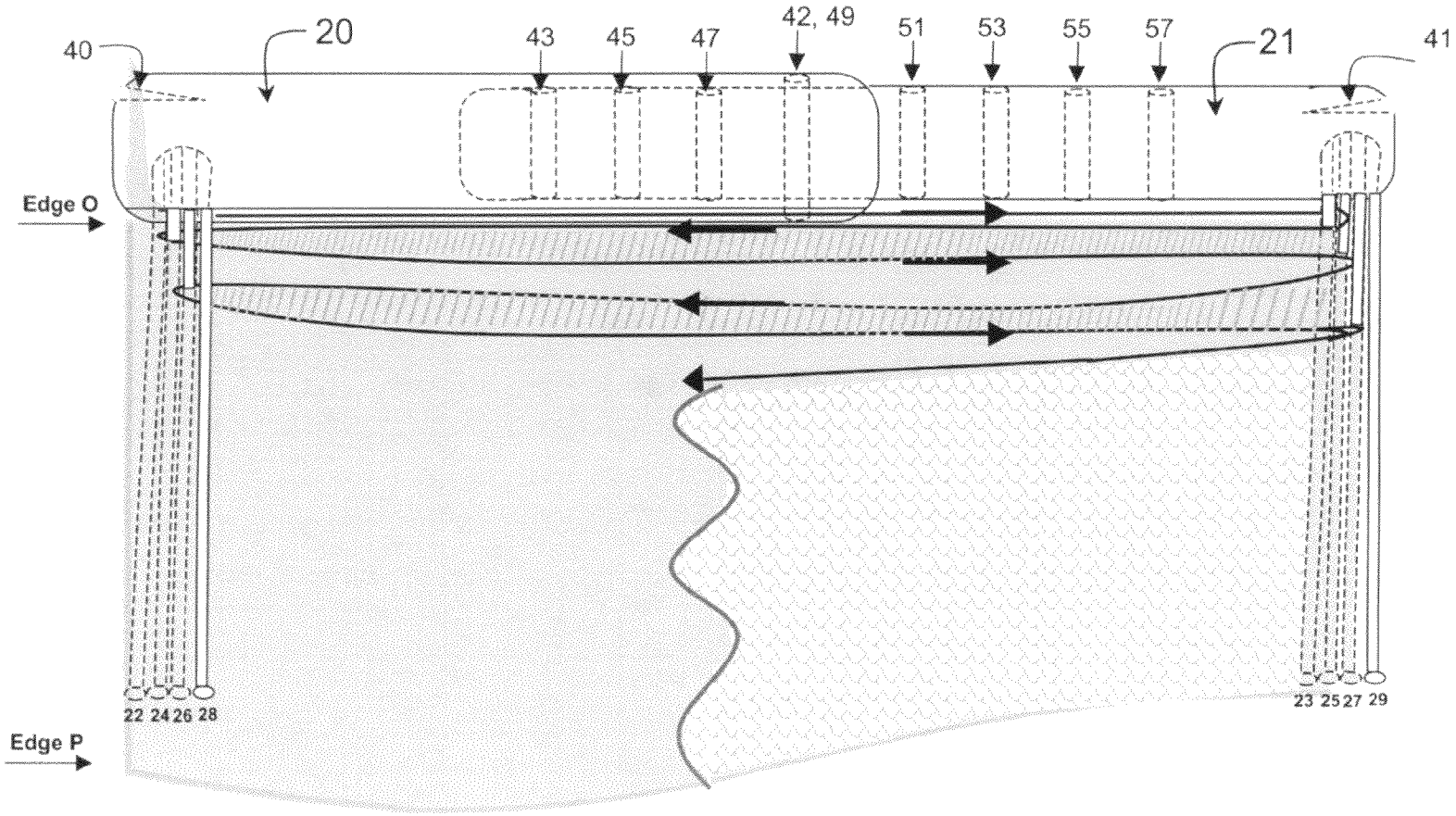
FIG. 12 is a side elevational view of the pleating apparatus with an illustrative fabric shown.

FIG. 12 illustrates weaving a fabric material through the pleating apparatus to create accordion pleats. Select the desired pleat width for appearance purposes by sliding and locking rigid support arm 21 within arm 20. Starting with one corner of the fabric to be woven, secure the end within clip 40 and weave through finger 22. The lateral edge O of the fabric is maintained parallel to the plane of interlocked support arms 20 and 21 throughout the weaving process. The fabric is then wrapped around opposing finger 23 and woven between adjacent fingers 22 and 24. The pleat created within the fabric penetrates the length of fingers 22 and 23. The fabric is then wrapped around opposing finger 24 and woven between adjacent fingers 23 and 25. The third pleat is created by wrapping the fabric around opposing finger 25 and weaving between adjacent fingers 24 and 26. The fabric is then woven around finger 26 and back across to opposed and adjacent fingers 25 and 27. Wrapping around finger 27 and weaving between opposed and adjacent fingers 26 and 28 illustrate continuation of the motion. As viewed from the front, the pleat thus formed has the appearance illustrated in FIG. 1. As viewed from the top, the pleat thus formed has the appearance of FIG. 2.

One form of fabric material for immediate application with the herein described pleating apparatus is a sari. The traditional steps to wearing a sari are illustrated in FIG. 13. A sari is bought and sold as a one-size-fits-all garment and can vary from 5.5 to 8 meters in length. Saris are composed of fabric material ranging from cotton, silk, chiffon, georgette, and polyester blends. The wearer customizes the fit of the sari for her body by modifying the pleat width and number of pleats taken with the fabric material. FIG. 13A shows that a sari is worn by beginning to tuck edge O into the right side of a petticoat. The lower edge of the sari, P, should be grazing the floor. The sari is tucked around the waist into the petticoat. Next the entire length of the sari is wrapped around the body once coming back in front on the right side. FIG. 13B illustrates creating five to eight uniform pleats of equal width, approximately 5 inches wide, and gathering the pleats together ensuring that the lower edge of the pleats are uniform as well. The pleats may be secured with a safety pin to prevent the pleats from scattering. The pleats, along edge O, are then tucked within the petticoat. The herein described pleating apparatus will play an essential role in this step. Creating uniform pleats requires practice, dexterity and patience. The pleating apparatus will assist the user by quickly creating uniform pleats within the fabric material. Drape the remaining fabric around the hips once more from left to right and bring the material to the front holding the top edge O of the sari as shown in FIG. 13C. The width of the sari is then manually pleated and brought up and over the left shoulder so that the end Q of the sari falls to the back of the knees as shown in FIG. 13D. The herein described pleating apparatus will also play an essential role in this step by increasing the ease at which uniform accordion pleats will be created. The sari may be secured to the shoulder by a small safety pin or broach.

I claim:

1. In combination, a hand-held pleating apparatus for use with any fabric material, specifically a sari (saree), dhoti, scarf, or sarong being composed of: two rigid support members or arms, with each said rigid support member containing five to ten laterally spaced fingers all interconnected to one another in fixed relation adjacent to their lower ends, with said fingers adapted to allow fabric material to be woven alternatively through opposing and adjacent fingers to create pleats, specifically accordion pleats, with said fingers coated with an agglutinative material taken from a group consisting essentially of plastic, rubberized, and flocking to improve fabric hold and retaining each pleat formation, with the two separate halves of the rigid support member being adjustable to varying widths to accordingly produce pleats of varying widths and a side cut or clip within said rigid support members that allows for capturing a single corner of the fabric material to be pleated.

2. The combination called for in claim 1 including two rigid support members or arms extending downwardly below are said fingers, said fingers being mounted to said arms.

3. The combination called for in claim 1 wherein half of all said fingers face the other half of said fingers to allow fabric material to be woven between all said fingers.

4. A hand-held pleating apparatus as called for in claim 1 wherein the two rigid arms may be of equal dimension or one said rigid support arm may be slightly wider than the other where said wider support arm may slightly curve up and over said narrower support arm and allow the narrow support arm to slide within the wider support arm.

5. The combination as called for in claim 1 wherein the two rigid support arms are held by a releasable locking mechanism at different positions on said arm allowing for varying widths of the pleating apparatus and the resulting pleats, where the narrowest pleat exceeds the width of a single support arm.

6. The combination called for in claim 5 wherein said locking mechanism comprises releasable latch members, including but not limited to a screw with washer/nut, locking ring, velcro, and having a plurality of protrusions with corresponding apertures.

7. The combination called for in claim 1 wherein said fingers are at least slightly resiliently flexible and tapered toward one another near the point of embedment near said support arm to allow for a tighter pinch to hold fabric folds of widely different thicknesses.

8. The combination called for in claim 1 wherein said attachment comprises two plastic molded parts having a body member from which said fingers project downwardly.

9. The combination called for in claim 1 wherein a said application is to assist in the wearing of a sari (saree).

* * * * *